US005089029A

United States Patent [19]

Hashimoto et al.

[11] Patent Number: 5,089,029

[45] Date of Patent: Feb. 18, 1992

[54] FUEL OIL ADDITIVE AND FUEL OIL ADDITIVE COMPOSITION

[75] Inventors: Jiro Hashimoto; Shogo Nomoto, both of Wakayama; Masanori Nozawa, Osaka; Makoto Kubo, Wakayama, all of Japan

[73] Assignee: Kao Corporation, Tokyo, Japan

[21] Appl. No.: 646,276

[22] Filed: Jan. 28, 1991

[30] Foreign Application Priority Data

Feb. 2, 1990 [JP] Japan ..... 2-24191

[51] Int. Cl.[5] ..... C10L 1/18

[52] U.S. Cl. ..... 44/432; 44/433; 252/52 A

[58] Field of Search ..... 44/432, 433

[56] References Cited

U.S. PATENT DOCUMENTS 3,440,029 4/1969 Little et al. .
4,247,301 1/1981 Hanner ..... 44/433
4,332,595 6/1982 Herbstman et al. .
4,604,103 8/1986 Campbell ..... 44/433
4,609,377 9/1986 Sung et al. .
4,778,481 10/1988 Courtney ..... 44/433
4,964,879 10/1990 Herbstman et al. ..... 44/434

FOREIGN PATENT DOCUMENTS 0100665 2/1984 European Pat. Off. .
0289785 11/1988 European Pat. Off. .
0310875 4/1989 European Pat. Off. .
2177719 1/1987 United Kingdom .

*Primary Examiner*—Jacqueline V. Howard
*Attorney, Agent, or Firm*—Birch, Stewart, Kolasch & Birch

[57] ABSTRACT

A fuel oil composition comprises fuel oil and 0.1 to 50,000 ppm of an additive compound having the formula (I) in which R is a hydrocarbyl radical having 10 to 50 carbon atoms, A is an alkylene group having 2 to 6 carbon atoms, m is an integer of 10 to 50 and n is an integer of 1 to 3. It is improved in cleaning property.

6 Claims, No Drawings

FUEL OIL ADDITIVE AND FUEL OIL ADDITIVE COMPOSITION

FIELD OF THE INVENTION

The present invention relates to a fuel oil additive, particularly gasoline additive and a fuel oil additive composition containing the same. More particularly, the present invention relates to a fuel oil additive which exhibits excellent cleaning properties for a fuel intake unit and a combustion chamber, and a fuel oil additive composition containing the same.

PRIOR ART

The formation of sediment such as sludge or deposit in a fuel system or a combustion chamber of an internal combustion engine exerts an adverse effect on the function of an engine or exhaust gas.

Therefore, a fuel detergent, particularly a gasoline detergent is added to gasoline for the purpose of removing the deposit formed in a gasoline intake unit such as a carburetor or an intake valve, inhibiting the formation of deposits and cleaning the combustion chamber. The deposit formed in an intake valve or an intake port is causative of lowering in the power output of an engine, impairment of driving properties or increase in the amount of exhaust gas. Recently, the performance of an engine has been enhanced more and more to make an engine more sensitive to the deposit described above. Particularly, the deposit formed in an intake valve has recently become a significant problem. For example, in Japan, the ratio of passenger cars fitted with an electronically controlled fuel injector has increased. An electronically controlled fuel injector can precisely control the mixing ratio of gasoline to air to be effective not only in enhancing the performance of an engine but also in improving fuel cost and exhaust gas. When deposit is formed in an intake valve, however, the gasoline injected from the injector hits against the deposit to deteriorate its control, so that the driving properties are adversely affected.

Various fuel oil additives have been proposed to solve the above problems.

For example, polyetheramines are disclosed in Japanese Patent Publication Nos. 48556/1981, 39278/ 1980 and 33016/1986 and Japanese Patent Laid-Open No. 25489/1980. These polyetheramines are insufficient respect to the cleaning properties for an intake valve.

Under these circumstances, the present invention aims at providing a fuel oil additive which exhibits excellent cleaning properties for an intake valve and is excellent in thermal decomposability and which can be easily prepared, and a fuel oil additive composition containing the same.

SUMMARY OF THE INVENTION

The inventors of the present invention have intensively studied to solve the problems of the prior art and have accomplished the present invention.

Namely, the present invention provides a fuel oil additive characterized by containing a compound represented by the following general formula (1) and a fuel oil additive composition characterized by comprising such an additive and a mineral or synthetic oil:

$$R—O—(AO)_m—(C_3H_6NH)_nH \quad (1)$$

wherein R is a hydrocarbyl radical having 10 to 50 carbon atoms; A is an alkylene group having 2 to 6 carbon atoms; m is an integer of 10 to 50; and n is an integer of 1 to 3.

The invention provides a fuel oil composition comprising fuel oil and 0.1 to 50,000 ppm of an additive compound having the formula (I) in which R is a hydrocarbyl radical having 10 to 50 carbon atoms, A is an alkylene group having 2 to 6 carbon atoms, m is an integer of 10 to 50 and n is an integer of 1 to 3.

$$R—O—(AO)_m—(C_3H_6NH)_nH \quad (I)$$

It is preferable that the composition comprises 1 to 20,000 ppm of the additive compound. It may further comprise 0.05 to 20 parts by weight, per 1 part of the additive compound, of a mineral or synthetic oil.

It is preferable that the mineral oil or synthetic oil is selected from the group consisting of poly-alpha-olefin, polybutene, an adduct of an alcohol with an alkylene oxide, an adduct of an alkylphenol with an alkylene oxide, an alkylene oxide polymer such as an addition product of propylene oxide or butylene oxide and an ester thereof.

The invention provides an additive composition to a fuel oil comprising the additive compound as defined above and a mineral or synthetic oil. It provides a fuel oil additive comprising the above defined compound (I).

The compound represented by the general formula (1) can be prepared by cyanoethylating an adduct of an alcohol, or alkylphenol having 10 to 50 carbon atoms and an alkylene oxide with acrylonitrile and hydrogenating the obtained product, if necessary, followed by the repetition of the cyanoethylation and the hydrogenation. The cyanoethylation is conducted by stirring the reaction system under heating in the presence of a strong base catalyst such as caustic alkali. The hydrogenation can be conducted in the presence of a hydrogenation catalyst such as Raney nickel.

However, the process for the preparation of the compound represented by the general formula (1) is not limited to the above process.

When the compound represented by the general formula (1) is prepared by the above process, the alcohol ROH [wherein R is the same as that defined for the general formula (1)]to be used as a raw material must have 10 to 50 carbon atoms. Examples of the alcohol include various saturated and unsaturated natural alcohols; straight-chain monohydric alcohols prepared by the Ziegler process and branched alcohols prepared by the oxo process or the Guerbet reaction.

Preferable examples of the alcohol include natural alcohols such as decyl, lauryl, palmityl, stearyl, eicosyl, behenyl, oleyl, elaidyl and erucyl alcohols; straight-chain monohydric alcohols having 10 to 30 carbon atoms prepared by the Ziegler process; branched alcohols having 10 to 24 carbon atoms prepared by the oxo process; and branched alcohols having 16 to 24 carbon atoms prepared by the Guerbet reaction.

The alkylphenol to be used as a raw material is one having one or two alkyl groups each having 4 to 40 carbon atoms, preferably 4 to 30 carbon atoms to contain 10 to 50 carbon atoms in total.

Particular examples thereof include butylphenol, amylphenol, octylphenol, nonylphenol, dinonylphenol, dodecylphenol, cumylphenol, alkylphenols wherein said alkyl group has 18 to 24 carbon atoms, and alkylphenols prepared by the reaction of an α-olefin having 6 to 30 carbon atoms with phenol.

The alkylene oxide to be added to the above alcohol or alkylphenol must have 2 to 6 carbon atoms. Propylene oxide and butylene oxides (1,2-, 2,3-, 1,3-and 1,4-isomers and mixtures thereof) are particularly preferable. The number of the alkylene oxide molecules to be added must be at least 10. When this number is less than 10, the resulting additive will be poor in the cleaning properties for an intake valve, thus being unfit for the purpose of the present invention. When it exceeds 50, on the contrary, the preparation of such an adduct will be difficult, thus being uneconomical, though the number has not particularly an upper limit.

The adduct of an alcohol as described above with an alkylene oxide as described above can be prepared by various processes. For example, a gaseous or liquid alkylene oxide having 2 to 6 carbon atoms (such as ethylene oxide or propylene oxide) is added to an alcohol in the presence of a catalyst such as caustic alkali under heating, if necessary in the presence of also a proper solvent.

Two or more alkylene oxides may be additionpolymerized in block or at random.

In the above general formula (1), n is an integer of 1 to 3. When n is 4 or above, emulsification will occur disadvantageously when water is included in a fuel oil.

The additive of the present invention is further improved in the deposit removing effect and the cleanness retaining effect, when used simultaneously with a mineral or synthetic oil generally called the "carrier oil"., Particularly, the simultaneous use of a synthetic oil is more effective. Examples of such a synthetic oil include olefin polymers such as poly-αolefin and polybutene; adducts of alcohol or alkylphenol with alkylene oxide; and alkylene oxide polymers such as addition products of alkylene oxide such as propylene oxide or butylene oxide and esters or ethers of the products. The amount of the mineral or synthetic oil to be added is preferably 0.05 to 20 parts by weight per one part by weight of the compound represented by the above general formula (1).

The additive for fuel oils according to the present invention exhibits excellent cleaning properties for a fuel intake unit and a combustion chamber, particularly for an intake valve. Further, it exhibits an excellent cleanness retaining effect even when used in a small amount.

The fuel oil additive according to the present invention is added to a fuel oil so as to give a concentration of 0.1 to 50,000 ppm. Although the addition of a larger amount of the additive gives more excellent cleaning properties, a practically sufficient effect can be obtained at a concentration of 1 to 20,000 ppm.

The additive of the present invention may be used together with other fuel oil additives such as rust preventive, anti-emulsion agent, antioxidant or metal deactivator. As described above, a fuel oil additive composition excellent in cleaning properties can be obtained by the addition of the fuel oil additive according to the present invention.

EXAMPLE

The present invention will now be described in more detail by referring to the following Synthesis Examples and Examples, though the present invention is not limited by them.

SYNTHESIS EXAMPLE 1

0.40 mol of nonylphenol (BO)20 (adduct of nonylphenol with twenty 1,2-butylene oxide molecules) was put in a 1-( four-necked flask. While keeping the contents at 76 to 80° C by heating and stirring in the presence of 2 mmol of caustic potash as a catalyst, 0.48 mol of acrylonitrile was dropped into the flask in a nitrogen atmosphere over a period of 3 hours and the resulting mixture was further reacted for 2 hours. The caustic potash was neutralized with acetic acid and excess acrylonitrile was distilled away in a vacuum. Thus, a cyanoethylated derivative was obtained.

300 g of the cyanoethylated derivative was put in a 1-l autoclave and hydrogenated under a hydrogen pressure of 20 kg/cm$^2$ in the presence of Raney nickel catalyst to give a compound represented by the formula:

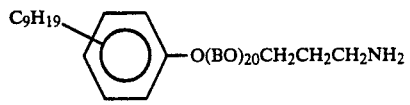

SYNTHESIS EXAMPLE 2

In a similar manner to that of Synthesis Example 1, a compound represented by the formula:

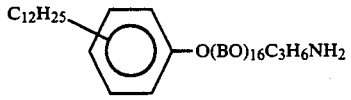

was prepared from dodecylphenol (BO)16 (adduct of dodecylphenol with sixteen 1,2-butylene oxide molecules).

SYNTHESIS EXAMPLE 3

In a similar manner to that of Synthesis Example 1, a compound represented by the formula:

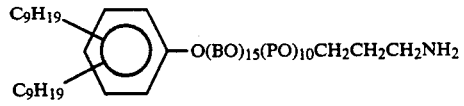

was prepared from dinonylphenol $(BO)_{15}$ $(PO)_{10}$ (adduct of dinonylphenol with fifteen 1,2-butylene oxide molecules and ten propylene oxide molecules).

SYNTHESIS EXAMPLE 4

In a similar manner to that of Synthesis Example 1, a compound represented by the formula:

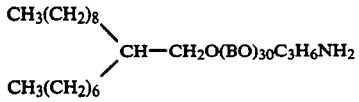

was prepared from 2-heptylundecanol (BO)30 (adduct of 2-heptylundecanol with thirty 1,3-butylene oxide molecules).

SYNTHESIS EXAMPLE 5

The compound represented by the formula:

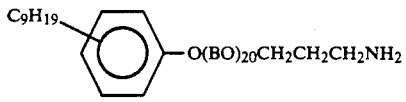

prepared in Synthesis Example 1 was cyanoethylated in a similar manner to that of Synthesis Example 1 and thereafter hydrogenated to give a compound represented by the formula:

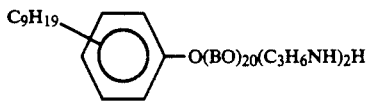

SYNTHESIS EXAMPLE 6

In a similar manner to that of Synthesis Example 1, a compound represented by the formula:

$CH_3(CH_2)_7CH{=}CH(CH_2)_7CH_2O(BO)_{20}CH_2CH_2CH_2NH_2$ was prepared from oleyl alcohol $(BO)_{20}$ (adduct of oleyl alcohol with twenty 1,2-butylene oxide molecules)

SYNTHESIS EXAMPLE 7

In a similar manner to that of Synthesis Example 1, a compound represented by the formula:

$CH_3(CH_2)_{14}CH_2O(BO)_{15}CH_2CH_2CH_2NH_2$ was prepared from palmityl alcohol $(BO)_{15}$ (adduct of palmityl alcohol with fifteen 1,2-butylene oxide molecules).

EXAMPLE 1

The additives of the present invention prepared in the foregoing Synthesis Examples 1 to 7 and a reaction product of ethylenediamine with a chloroformate of dodecylphenol $(BO)_{25}$ (adduct of dodecylphenol with twenty-five 1,2-butylene oxide molecules) [hereinafter abbreviated, as "comparative additive"] were each subjected to the following thermal decomposition test to determine whether the additive in itself forms deposit in a combustion chamber or not.

Namely, about 1 g of an additive sample (50% kerosine solution) was accurately weighed into an aluminum cup. The cup was placed in a thermostatic chamber and kept at 200° C. for 15 hours to determine the residual weight. The percentage decomposition was calculated according to the following equation wherein Wi is the weight of the sample used and Wr is the residual weight:

$$\text{Rate of decomposition (\%)} = (Wi\text{-}Wr\text{-}Wi/2) / (Wi/2) \times 100$$

Further, the appearance of the residue was observed with the naked eye.

The results are given in Table 1.

TABLE 1

| | Kind of additive | Rate of decomposition (%) | Appearance of residue |
|---|---|---|---|
| Invention | Syn. Ex. 1 | 92 | light lacquer-like |
| | Syn. Ex. 2 | 91 | " |
| | Syn. Ex. 3 | 90 | " |
| | Syn. Ex. 4 | 95 | " |
| | Syn. Ex. 5 | 85 | " |
| | Syn. Ex. 6 | 81 | " |
| | Syn. Ex. 7 | 85 | " |
| Comparative | | 70 | lacquer-like |

As is apparent from the results given in Table 1, all of the additives of the present invention exhibited excellent thermal decomposability.

EXAMPLE 2 (fleet test)

One tank (61 l) of gasoline containing 1% by weight of an additive was used in the travelling on a common road. Before and after the test, the engine was disassembled to observe the intake unit (intake valve and intake port), combustion chamber and carburetor and intake valve. Thus, the extent of the removal of deposit was evaluated. The car used is TOYOTA CARINA 1800 cc (engine type: 1S). This car was one which had run for about 20000 km.

The extent of the removal of deposit was evaluated according to the following criteria:

| | |
|---|---|
| X | increase in the amount of deposit |
| — | no change |
| Δ | poor deposit removing effect |
| ○ | tolerable deposit removing effect |
| ◎ | excellent deposit removing effect |

The results are given in Table 2.

TABLE 2

| | Fuel oil additive *1 | Extent of the removal of deposit | | | | |
|---|---|---|---|---|---|---|
| | | intake valve | intake port | upper part of combustion chamber | piston head | carburetor |
| Invention | 50% solution of the additive of Syn. Ex. 1 | ○~◎ | ○ | ○ | Δ | ○ |
| | 50% solution of the additive of Syn. Ex. 2 | ○~◎ | ○ | ○~Δ | Δ | ○ |
| | 50% solution of the additive of Syn. Ex. 3 | ○~◎ | ○ | Δ | Δ | ○ |
| | 50% solution of the additive of Syn. Ex. 4 | ○~◎ | ○ | ○~Δ | Δ | ○ |
| | 50% solution of the additive of Syn. Ex. 5 | ○~◎ | ○ | Δ | Δ | ○ |
| | 50% solution of the additive of Syn. Ex. 6 | ○~◎ | ○ | Δ | Δ | ○ |
| | 50% solution of the additive of Syn. Ex. 7 | ○~◎ | ○ | Δ | Δ | ○ |
| | 50% solution of the additive of Syn. Ex. 8 | ○ | ○ | Δ | ○~Δ | ◎ |

TABLE 2-continued

| Fuel oil additive *1 | Extent of the removal of deposit | | | | |
|---|---|---|---|---|---|
| | intake valve | intake port | upper part of combustion chamber | piston head | carburetor |
| tive of Syn. Ex. 6 | | | | | |
| composition containing the additive of Syn. Ex. 1 | ◎ | ○ | ○~Δ | ○~Δ | ○ |
| composition containing the additive of Syn. Ex. 3 | ◎ | ○ | ○~Δ | ○~Δ | ○ |
| 50% solution of the comparative additive | ○~Δ | ○~Δ | — | — | Δ |

Note

*1 each of the 50% solutions was prepared by diluting each of the additives prepared in Synthetic Examples and Comparative one with an aromatic solvent to 50%. The compositions each comprise the following components:

| | |
|---|---|
| compound prepared in Synthesis Example | 1 part by weight |
| adduct of nonylphenol with 15 butylene oxide molecules [nonylphenol $(BO)_{15}$] | 1 part by weight |
| aromatic solvent | 2 part by weight |

EXAMPLE 3 (fleet test 2)

The fuel oil additives were examined for the cleanness retaining effect according to the following test.

Regular gasoline containing 250 ppm of a fuel oil additive was used in the travelling on a common road. Before and after the test, the engine was disassembled to observe the intake unit (intake valve, intake port and carburetor) and combustion chamber. Thus, the extent of the formation of deposit was evaluated. With respect to the intake valve, the weight thereof was measured before and after the test to determine the amount of the deposit formed. The car used is NISSAN CEDRIC Brougham) VIP 3000 cc (engine type: VG-30G).

Prior to the test, the intake unit and combustion chamber of the car were cleaned to remove the deposit.

The extent of the retention of cleanness was evaluated according to the following criteria based on the result given when no fuel oil additive was used.

| | |
|---|---|
| X | increase in the amount of deposit |
| — | equivalent to the result given when no additive was used |
| Δ | the cleanness retaining effect is a little superior to the one exhibited when no additive was used |
| ○ | nearly no deposit was formed |
| ◎ | no deposit was formed |

The results are given in Table 3.

TABLE 3

| | Fuel oil additive *1 | Extent of the retention of cleanness | | | | | |
|---|---|---|---|---|---|---|---|
| | | intake valve | intake port | upper part of combustion chamber | piston head | carburetor | wt. change of intake valve *2 (mg) |
| Invention | 50% solution of the additive of Syn. Ex. 1 | ○ | ○ | Δ | — | ○ | 58 |
| | 50% solution of the additive of Syn. Ex. 2 | ○ | ○ | Δ | — | ○ | 70 |
| | 50% solution of the additive of Syn. Ex. 3 | ○ | ○ | Δ | — | ○ | 72 |
| | 50% solution of the additive of Syn. Ex. 4 | ○ | ○ | Δ | — | ○ | 65 |
| | 50% solution of the additive of Syn. Ex. 5 | ○ | ○~◎ | Δ | — | ◎ | 85 |
| | composition containing the additive of Syn. Ex. 1 | ○~◎ | ○~◎ | Δ~○ | Δ | ○ | 21 |
| | composition containing the additive of Syn. Ex. 3 | ○~◎ | ○~◎ | Δ~○ | Δ | ○ | 29 |
| 50% solution of the comparative additive | | Δ | Δ | — | — | ○ | 120 |

Note

*1 each of the 50% solutions was prepared by diluting each of the additives prepared in Synthetic Examples and Comprative one with an aromatic solvent to 50%. The compositions each comprise the following components:

| | |
|---|---|
| compound prepared in Syn. Ex. | 1 part by weight |
| adduct of nonylphenol with 15 butylene oxide molecules [nonylphenol $(BO)_{15}$] | 1 part by weight |
| aromatic solvent | 2 parts by weight |

*2 The weight change of an intake valve is given by an average of the weight changes of six intake valves and corresponds to the amount of the deposit formed.

EFFECT OF THE INVENTION

The fuel oil additives according to the present invention are superior to the comparative additives in thermal decomposability and has been ascertained from the results of fleet tests to be excellent in the deposit removing power and cleanness retaining power for a fuel intake unit and a combustion chamber.

We claim:

1. A fuel oil composition which comprises (a) fuel oil;

(b) 1 to 20,000 ppm of an additive compound having the formula $$R—O—(AO)_m—(C_3H_6NH)_nH \quad (I)$$

wherein R is a hydrocarbyl radical having 10 to 50 carbon atoms, A is an alkylene group having 2 to 6 carbon atoms, m is an integer of 10 to 50 and n is an integer of 1 to 3; and (c) 0.05 to 20 parts by weight, per 1 part of said additive compound, of a mineral or synthetic oil.

2. The composition as claimed in claim 1 in which the mineral oil or synthetic oil is selected from the group consisting of poly-alpha-olefin, polybutene, an adduct of an alcohol with an alkylene oxide, an adduct of an alkylphenol with an alkylene oxide, an alkylene oxide polymer and ester thereof.

3. The composition as claimed in claim 1 in which the mineral oil or synthetic oil is selected from the group consisting of an addition product of propylene oxide or butylene oxide and an ester thereof.

4. A fuel additive composition which comprises an additive compound having the formula $$R—O—(AO)_m—(C_3H_6N)_nH$$

wherein R is a hydrocarbyl radical having 10 to 50 carbon atoms, A is an alkylene group having 2 to 6 carbon atoms, m is an integer of 10 to 50 and n is an integer of 1 to 3; and 0.05 to 20 parts by weight, per 1 part of said additive compound, or a mineral or synthetic oil.

5. The composition as claimed in claim 4 wherein the mineral oil or synthetic oil is selected from the group consisting of poly-alpha-olefin, polybutene, an adduct of an alcohol with an alkylene oxide, an adduct of an alkylphenol with an alkylene oxide, an alkylene oxide polymer and an ester thereof.

6. The composition as claimed in claim 4 wherein the mineral oil or synthetic oil is selected from the group consisting of an addition product of propylene oxide or butylene oxide and an ester thereof.

* * * * *